United States Patent [19]

Takami

[11] Patent Number: 5,076,089

[45] Date of Patent: Dec. 31, 1991

[54] METHOD OF MANUFACTURING A HEMISPHERE SHOE FOR A SWASH PLATE COMPRESSOR

[75] Inventor: Yasuhiko Takami, Aichi, Japan

[73] Assignee: Chubu Rashiseisakusho Co., Ltd., Nagoya, Japan

[21] Appl. No.: 492,993

[22] Filed: Mar. 13, 1990

[30] Foreign Application Priority Data

Dec. 28, 1989 [JP] Japan ..... 1-342573

[51] Int. Cl.[5] ..... B21K 1/76

[52] U.S. Cl. ..... 72/356; 72/364

[58] Field of Search ..... 72/356, 360, 377, 340, 72/364; 148/130

[56] References Cited

U.S. PATENT DOCUMENTS

| | | | |
|---|---|---|---|
| 3,378,412 | 4/1968 | Mansfield et al. | 148/130 |
| 3,675,459 | 7/1972 | Dohmann | 72/377 |
| 4,754,908 | 7/1988 | Tanaka et al. | 72/368 |

FOREIGN PATENT DOCUMENTS

| | | | |
|---|---|---|---|
| 162534 | 6/1989 | Japan | 72/360 |

*Primary Examiner*—Lowell A. Larson

*Attorney, Agent, or Firm*—Burns, Doane, Swecker & Mathis

[57] ABSTRACT

A method of manufacturing a hemisphere shoe provided between a piston and a slant plate of a swash plate compressor, said method comprises the steps of: cutting a cylindrical blank corresponding to a weight of the hemisphere shoe; plastic-working the cylindrical blank into a blank to be cold-forged having a large diameter plane portion at one end and a small diameter plane portion at another end and a body portion having a curved surface and a higher height than the finished hemisphere shoe and a smaller maximum diameter than the finished hemisphere shoe in a middle portion of the blank; positioning the blank so that the small diameter plane portion contacts with a recess die sufrace of a first die and the large diameter plane portion contacts with a substantially plane die surface of a second die; cold-forging the blank to be cold-forged by pressing the both dies till the dies are in a close contact with each other by means of a cold-forging press including the first die haivng a hemisphere recess die of a substantial hemisphere shape with a radius anticipating a strain caused by a heat-treating; heat-treating the cold-forged hemisphere shoe; and glaze-plishing the heat-treated hemisphere shoe.

8 Claims, 3 Drawing Sheets

METHOD OF MANUFACTURING A HEMISPHERE SHOE FOR A SWASH PLATE COMPRESSOR

BACKGROUND OF THE DISCLOSURE

The invention relates to a method of manufacturing a hemisphere shoe for use in a swash plate compressor included in various industrial apparatuses, such as a car air conditioner.

As illustrated in FIG. 6, a hemisphere shoe 40 is provided between a slant plate 61 and a piston 62 so that the piston 62 is reciprocated by the slant plate 61 which is rotated by a rotary shaft. At first, the inventor of the invention examined a manufacture of a hemisphere shoe by means of cutting a wire and subsequently plastic-working the wire using three or four stage dies provided in a part former. However, it is difficult to produce a high precision height of the hemisphere shoe by means of the plastic-working using the part former. Therefore, it is necessary to produce the high precision height of the hemisphere shoe by means of a surface grinding and a cutting prior to a quenching. Also, production of a large quantity of the hemisphere shoes requires much time and labor and many grinding and cutting machines in order to perform the grinding and the cutting, which results in being expensive in a manufacturing cost.

SUMMARY OF THE INVENTION

An object of the invention is to provide a method which requires a minimum process and cost and which is inexpensive to manufacture a hemisphere shoe.

Another object of the invention is to provide a method which allows manufacturing a hemisphere shoe with a high production efficiency.

A further object of the invention is to provide a method which allows production of a height precision and a sphere degree required for a hemisphere shoe.

A further object of the invention is to provide a method which allows manufacturing a hemisphere shoe without additional processes, such as a grinding and a cutting.

An even further object of the invention is to provide a method which allows manufacturing a hemisphere shoe without loss of materials.

In accordance with the invention, there is provided a method of manufacturing a hemisphere shoe for a swash plate compressor, comprising the steps of: cutting a cylindrical blank corresponding to a weight of the hemisphere shoe from a steel wire; plastic-working the cylindrical blank into a blank to be cold-forged which has a large diameter plane portion at one end, a small diameter plane portion at another end and a body portion having a curved surface and a higher height and a smaller maximum diameter than the finished hemisphere shoe between the both plane portions; positioning the blank so that the small diameter plane portion contacts with a recess die surface of a first die and the large diameter plane portion contacts with a substantially plane die surface of a second die and thereafter cold-forging the blank by pressing the both dies till they are in a close contact with each other by means of a cold-forging press including the first die having the recess die surface of a substantial hemisphere shape with a radius anticipating a strain caused by a heat-treating and the second die having a substantially plane die surface; heat-treating the cold-forged hemisphere shoe; and glaze-polishing the heat-treated hemisphere shoe.

In accordance with the above steps the cylindrical blank corresponding to the weight of the finished hemisphere shoe is cut from the steel wire in a first step and the cylindrical blank is plastic-worked into the blank to be cold-forged in a second step. A shape of the blank to be cold-forged is the one which is capable of being cold-forged into the desired hemisphere shoe by means of the cold-forging of a third step. Namely, the blank to be cold-forged includes the large diameter plane portion at the one end and the small diameter plane portion at the other end and the body portion having the curved surface and the higher height and the smaller maximum diameter than the finished hemisphere shoe. In the third step, the blank is cold-forged by pressing the first and the second die till they are in the close contact with each other by means of the cold-forging press including the first die having the recess die surface of the substantial hemisphere shape with the radius anticipating the strain caused by the heattreating and the second die having the substantially plane die surface, so that the high precision height of the hemisphere shoe can be produced accurately. When the blank to be cold-forged is pressed by the both dies, the small diameter plane portion and a part of the body portion having the curved surface subsequent to the small diameter plane portion contacts with the recess die surface of the substantial hemisphere of the first die to form a sphere surface portion corresponding to a shape of the recess die surface. Meanwhile, the large diameter plane portion and a part of the body portion having the curved surface are formed into a substantial plane corresponding to a shape of the substantially plane die surface. The hemisphere shoe formed by the cold-forging anticipates the strain caused by the heat-treating, there-fore the hemisphere shoe having a desired hardness, radius and height can be produced in a fourth process. In a fifth step, the heat-treated hemisphere shoe is not worked and is polished to have a glaze. As a result thereof, the hemisphere shoe having a desired surface smoothness can be manufactured.

Other and further objects, features and advantages of the invention will become appear more fully from the following description.

DETAILED DESCRIPTION OF THE PREFERRED EMBODIMENT

Figure 1:
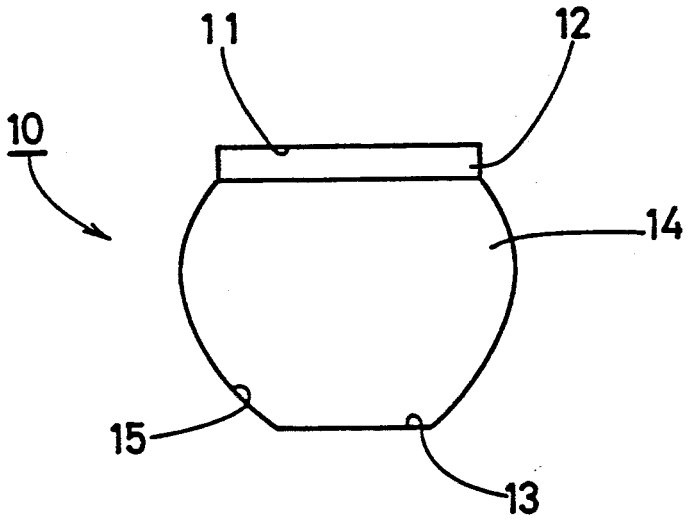
FIG. 1 is a front view of a blank to be cold-forged.

Referring to the drawings, an embodiment of the invention is hereinafter described.

FIG. 1 illustrates a blank to be cold-forged 10 which is formed by a cutting of a first step and a plastic-working of a second step. The first step and the second step are performed by a known structure header, which comprises a cutting die, a knife, a first die, a second die, a first punch, and a second punch. The cutting die and the knife are used to cut a cylindrical blank from a steel wire. The cylindrical blank is cut into a length corresponding to a weight of a finished hemisphere shoe. The first die, the first punch, the second die, and the second punch plastic-work the cylindrical blank into the blank 10 which is characterized in shape (hereinafter referred to as a preformed blank), as illustrated in FIG. 1. The preformed blank 10 is formed into the characterized shape illustrated in FIG. 1, so that the high precision hemisphere shoe can be manufactured by means of a cold-forging of a third step, a heat-treating of a fourth step, and a glaze-polishing of a fifth step. That is, as illustrated in FIG. 1, the preformed blank 10 comprises a large diameter plane portion 11 at an upper end, a small diameter plane portion 13 at a lower end, a neck portion 12 which is substantially cylindrical and extremely short and which is subsequent to the large diameter plane portion 11, and a body portion 14 having a curved surface between the plane portions 11 and 13. The body portion 14 has a higher height and a smaller maximum diameter than the finished hemisphere shoe. The body portion 14 includes a substantially spherical surface portion 15 subsequent to the small diameter plane portion 13. It is desirable that the preformed blank 10 is formed so as to have the higher height by substantially 10% than the finished hemisphere shoe and have the smaller maximum diameter by substantially 10% than the finished hemisphere shoe. A weight of the preformed blank 10 is controlled so as to be in a range of a standard weight with an accuracy of 0.01 mg so that the high precision hemisphere shoe can be manufactured. A surface state of the spherical surface portion has a great effect upon a sphere degree and a spherical surface roughness of the hemisphere shoe. Therefore, the surface state of the spherical surface portion preferably has neither crack nor burr. Various steel materials which can be quenched, besides a structural steel, can be used as materials of the preformed blank 10.

Figure 2:
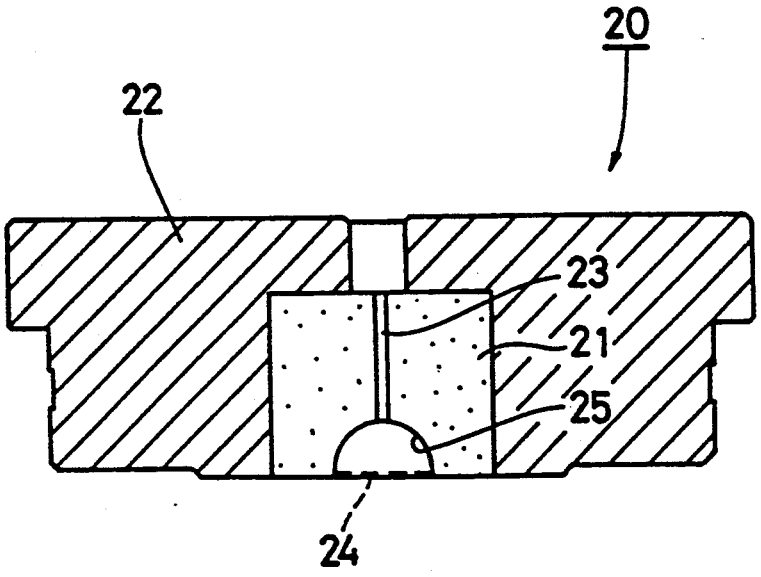
FIG. 2 is a cross sectional view of an upper die which is used in a cold-forging.
Figure 3:
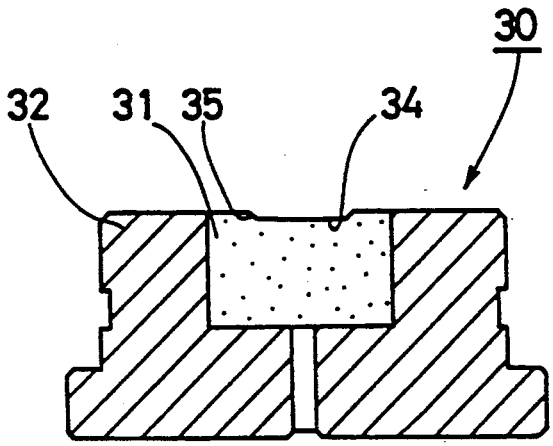
FIG. 3 is a cross sectional view of a lower die which is used in the cold-forging.

In the cold-forging of the third step, an upper die 20 illustrated in FIG. 2 and a lower die 30 illustrated in FIG. 3 are used. The upper die 20 comprises a hemisphere recess die 21 whose material is WC-Co and a holding member 22 which holds the hemisphere recess die 21. For example, SKD 61 is used as the material of the holding member 22. A recess die surface 25 of the hemisphere recess die 21 is formed into a substantially hemispherical shape having a smaller radius by 30 to 50 μm than a sphere surface of the finished hemisphere shoe in anticipation of a strain caused by the heat-treating. The present invention, however, is not limited to the size of the radius. In the present invention, a tendency for the strain caused by the heat-treating is found by means of a previous test in view of the material and the radius and the recess die surface 25 is formed into a radius anticipating the strain and is lapped. The hemisphere recess die 21 is provided with a pin hole 23 for an air vent and a knockout. An inlet of the hemisphere recess die 21 is provided with a cylindrical portion 24 of 300 to 500 μm which has the same diameter with the maximum diameter of the recess die surface 25 for an escape part.

The lower die 30 comprises a plane die 31 and a holding member 32 which holds the plane die 31, as illustrated in FIG. 3. A plane portion 34 is formed in a center of the plane die 31 and a slant face portion 35 having a cylindrical cone surface is formed so as to surround the plane portion 34. It is desirable that the material of the plane die 31 should be WC. Also, it is preferable that the material of the holding member 32 should be SK steel. The upper die 20 is installed in a ram of a cold-forging press and is moved upward and downward. The lower die 30 is fixedly installed in a bolster of the cold-forging press.

Figure 4:
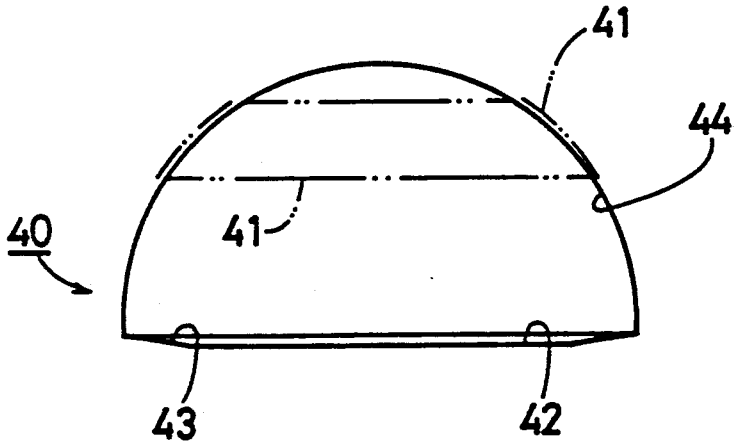
FIG. 4 is a front view of a completely manufactured hemisphere shoe.

FIG. 4 illustrates the finished hemisphere shoe 40. A two-point chain line shows a spherical portion 41. The spherical portion 41 contacts with a piston 62 of a swash plate compressor, therefore the spherical portion 41 should preferably have a desired radius with an accuracy of substantially 5 μm. It is confirmed by fitting of basic copper carbonate whether the accuracy of the spherical portion 41 is obtained or not. A diameter of a starting portion of a top of the fitting of the basic copper carbonate is controlled on a plus side and should preferably be larger than a standard diameter in view of a better swash movement of the swash plate compressor. The fitting of the basic copper carbonate should desirably be 2 points or more over an entire periphery of the spherical portion 41. It is desirable that the fitting of the basic copper carbonate is not partial except the spherical portion 41. The height of the hemisphere shoe 40 is required to be substantially 5 μm in order to keep a distance between a slant face of a slant plate 61 and the piston 62 with a high accuracy. It is necessary to manufacture a plane portion 42 having a high smoothness degree of substantially four triangles (▽▽▽▽) since the plane portion 42 should slide smoothly on the slant plate 61 of the swash plate compressor at high speed. A slant surface portion 43 having a cylindrical cone is provided at a periphery of the plane portion 42. The plane portion 42 is connected with a spherical surface portion 44 via the slant surface portion 43. A connection point between the plane portion 42 and the slant surface portion 43 and that between the slant surface portion 43 and the spherical surface portion 44 are formed into a rounded peripheral edge. Also, it is important for a hardness of the hemisphere shoe to be within a standard value of substantially HV 650 to 900, for example.

Figure 5:
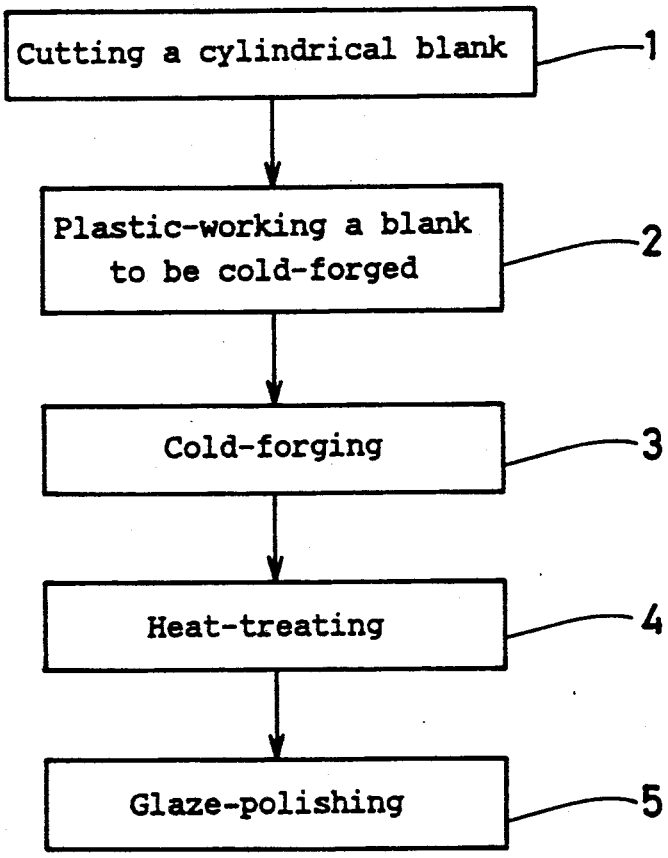
FIG. 5 is a process diagram.
Figure 6:
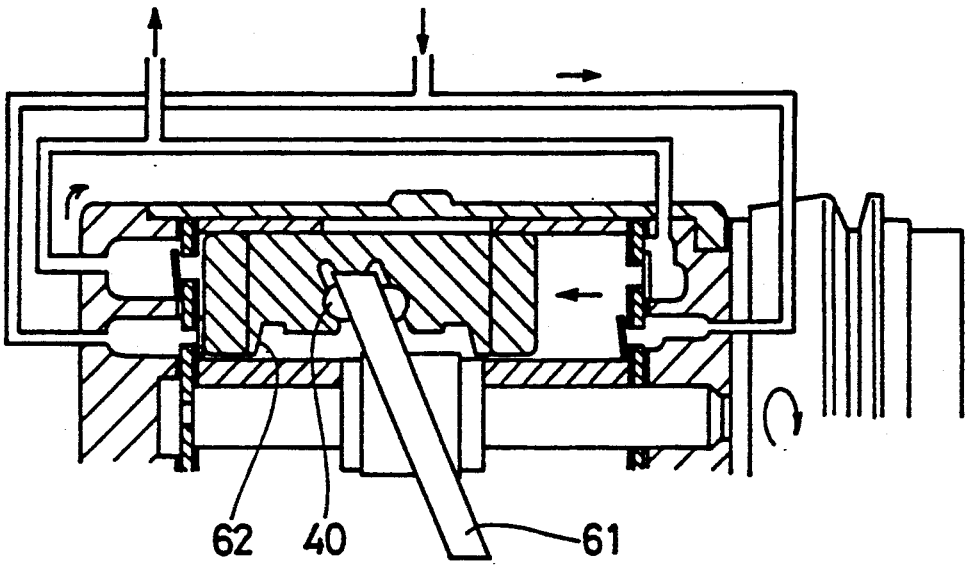
FIG. 6 is a cross sectional view of a swash plate compressor for explanation of a background of the invention.

Next, a manufacturing method of the present invention is explained by the use of FIGS. 1 to 4 and 5. As illustrated in FIG. 5, the manufacturing method of the present invention includes the first step 1 to the fifth step 5. The first step 1 and the second step 2 are performed by a header. In the first step, the cylindrical blank is cut from the steel wire. In the second step, the cylindrical blank is plastic-worked into the blank to be cold-forged (the preformed blank) 10 having the characterized shape. In the third step, the preformed blank 10 is cold-forged by the upper die 20 illustrated in FIG. 2 and the lower die 30 illustrated in FIG. 3. The cold-forging is performed by the following steps in order: reversing a top-to-bottom orientation of the preformed blank 10 illustrated in FIG. 1, placing the preformed blank 10 on the lower die 30, contacting the large diameter plane portion 11 with the plane die 31, lowering the upper die 20, and pressing the both dies 20 and 30 till the hemisphere recess die 21 of the upper die is in the close contact with the plane die 31 of the lower die 30. In accordance with the third step, the small diameter plane portion 13 and the spherical surface portion 15 included by the body portion 14 are mainly plastic-worked by the hemisphere recess die 21 of the upper die 20 into the spherical surface portion 44 including the spherical portion 41 illustrated in FIG. 4. Also, the large diameter plane portion 11 and an upper portion included by the body portion 14 is diameter-enlarged by contacting with the plane die 31 of the lower die 30 into a lower portion including the plane portion 42, the slant surface portion 43 and the spherical surface portion 44.

The fourth step 4 is a heat-treating step, wherein a quenching and a tempering are performed. A vacuum quenching, a high-frequency quenching or a continuous heat-treating furnace is available to the quenching. A hardness of the hemisphere shoe after the quenching and the tempering is controlled to be within standard values determined in a range of HV 650 to 900.

The fifth step 5 is a glaze-polishing, wherein a barrel-polishing is performed to give a glaze to the plane portion 42, the slant surface portion 43 and the spherical surface portion 44 without changing a weight of the hemisphere shoe 40. The plane portion 42 is needed to have smoothness of approximately four triangles (▽▽▽▽) since it slides on the slant plate 61 at high speed.

EFFECTIVENESS

As noted above, the method of the invention includes the first step to the fifth step. The plastic-working performed by means of the header and the cold-forging performed by means of the cold-forging press provides mass productivity. Also, the cold-forging by closely contacting the upper die with the lower die requires no additional steps, such as a grinding and a cutting so as to produce the high precision height and the sphere degree of the hemisphere shoe, which results in no wastage of materials. Accordingly, the method of the invention which requires a minimum process and cost so as to manufacture the hemisphere shoe is advantageous in being fit for the mass productivity and being the most suitable for a low cost productivity.

What is claimed is:

1. A method of manufacturing a hemisphere shoe provided between a piston and a slant plate of a swash plate compressor, said method comprising the steps of:

cutting a cylindrical blank substantially equal in weight to a weight of the hemisphere shoe;

plastic-working the cylindrical blank into a blank to be cold-forged having a large diameter plane portion at one end and a small diameter plane portion at another end and a body portion having a curved surface and a higher height than the finished hemisphere shoe and a smaller maximum diameter than the finished hemisphere shoe in a middle portion of the blank;

positioning the blank so that the small diameter plane portion contacts with a recess die surface of a first die and the large diameter plane portion contacts with a substantially planar die surface of a second die;

cold-forging the blank to be cold-forged by pressing the first and second dies until the dies are in a close contact with each other by means of a cold-forging press such that the cold-forged hemisphere shoe has a first substantially hemispherical shape;

heat-treating the cold-forged hemisphere shoe to form a heat-treated hemisphere shoe having a second substantially hemispherical shape larger than said first substantially hemispherical shape due to a predetermined strain which the cold-forged hemisphere shoe undergoes during said heat-treating step; and glaze-polishing the heat-treated hemisphere shoe, wherein the first die includes a hemisphere recess die surface having a substantially hemispherical die shape which is preselected to form said first substantially hemispherical shape based on an amount of said predetermined strain.

2. The method according to claim 1, wherein the blank to be cold forged is plastic-worked so that a body portion of the cold-forged hemisphere shoe formed from the small diameter plane portion of the blank has a substantially hemispherical surface portion without burrs.

3. The method according to claim 1, wherein the blank to be cold-forged has the large diameter plane portion at an upper end of the blank and the small diameter plane portion at a lower end of the blank and the body portion between the plane portions.

4. The method according to claim 1, wherein the cold-forging step is performed by the following steps in order:

reversing a top-to-bottom orientation of the blank to be cold-forged;

positioning the blank on a lower die which is the second die having the substantially planar die surface; and pressing the blank with an upper die which is the first die having the recess die surface.

5. The method according to claim 1, wherein the blank to be cold-forged is formed with a higher height by substantially 10% than the finished hemisphere shoe and a smaller maximum diameter by substantially 10% than the finished hemisphere shoe.

6. The method according to claim 1, wherein the substantially hemispherical die shape of the recess die surface of the first die has a radius which is smaller than the radius of the second substantially hemispherical shape of the finished hemisphere shoe in anticipation of the predetermined strain caused by the heat-treating.

7. The method according to claim 1, wherein the recess die surface of the first die includes a short cylindrical portion having a diameter which is the same as a maximum diameter of the substantially hemispherical die shape and which extends from the substantially hemispherical die shape to a die end.

8. The method according to claim 1, wherein the substantially planar die surface of the second die includes a circular plane portion in a center thereof and a frustoconical surface connecting an outer diameter of the circular plane portion and an outer portion of the substantially planar die surface.

* * * * *